US008985402B2

(12) United States Patent
Schneider et al.

(10) Patent No.: US 8,985,402 B2
(45) Date of Patent: Mar. 24, 2015

(54) COVE BASE NOZZLE FOR DISPENSING APPLICATIONS

(71) Applicants: Mark C. Schneider, Moorestown, NJ (US); Brian J. MacKenzie, Philadelphia, PA (US)

(72) Inventors: Mark C. Schneider, Moorestown, NJ (US); Brian J. MacKenzie, Philadelphia, PA (US)

( * ) Notice: Subject to any disclaimer, the term of this patent is extended or adjusted under 35 U.S.C. 154(b) by 0 days.

(21) Appl. No.: 13/739,476

(22) Filed: Jan. 11, 2013

(65) Prior Publication Data

US 2013/0126558 A1 May 23, 2013

Related U.S. Application Data

(63) Continuation-in-part of application No. 12/724,025, filed on Mar. 15, 2010, now abandoned.

(60) Provisional application No. 61/160,853, filed on Mar. 17, 2009.

(51) Int. Cl.

| | |
|---|---|
| ***B65D 88/54*** | (2006.01) |
| ***B65D 47/06*** | (2006.01) |
| ***B05C 17/005*** | (2006.01) |
| ***B65D 25/48*** | (2006.01) |
| ***B65D 35/38*** | (2006.01) |
| ***B65D 47/10*** | (2006.01) |

(52) U.S. Cl.

CPC ..... *B65D 47/06* (2013.01); *B05C 17/00516* (2013.01); *B65D 25/48* (2013.01); *B65D 35/38* (2013.01); *B65D 47/10* (2013.01)

USPC ..... 222/330; 222/567; 222/568; 222/569; 222/575

(58) Field of Classification Search

USPC ..... 222/330, 331, 568, 567, 569, 573, 575

See application file for complete search history.

(56) References Cited

U.S. PATENT DOCUMENTS

| | | | | | |
|---|---|---|---|---|---|
| 361,313 | A | * | 4/1887 | Muller | 222/185.1 |
| 878,182 | A | * | 2/1908 | Blake | 222/92 |
| 1,088,797 | A | * | 3/1914 | Smith | 401/11 |
| 1,238,108 | A | * | 8/1917 | Cole | 222/604 |
| 1,986,166 | A | * | 1/1935 | Schneider | 222/323 |
| 2,102,209 | A | | 12/1937 | McDannold | |
| D136,098 | S | * | 8/1943 | Hartman, Sr. | D9/447 |
| 2,555,563 | A | * | 6/1951 | Benton | 222/323 |
| 2,660,251 | A | | 11/1953 | Birosh | |

(Continued)

OTHER PUBLICATIONS

Albion Dispensing Solutions Product Catalog #264C titled "Nozzles Metal and Plastic for Dispensing Applications" of Albion Engineering Company of Moorestown, NJ.

*Primary Examiner* — Kevin P Shaver
*Assistant Examiner* — Michael J Melaragno

(57) ABSTRACT

A nozzle assembly for dispensing viscous material is disclosed. The nozzle assembly is convertible from use with a device for dispensing bulk viscous material to use with a device for dispensing viscous material from a cartridge. Alternatively, the nozzle assembly is convertible from use with a device for dispensing viscous material from a sausage package to use with a device for dispensing from a cartridge. When dispensing viscous material from a cartridge, the base portion is arranged for receiving the cartridge conical tip and the flange is arranged for placement between an end plate of the dispenser and the cartridge to retain said nozzle within said dispenser for dispensing viscous material from the cartridge. When dispensing viscous material in bulk form or from a sausage package, a locking plate is provided for tightly retaining the nozzle to the end cap of the dispensing device.

11 Claims, 6 Drawing Sheets

(56) References Cited

U.S. PATENT DOCUMENTS

| | | | | | |
|---|---|---|---|---|---|
| 2,754,033 | A | * | 7/1956 | Etter | 222/326 |
| 2,821,332 | A | * | 1/1958 | Sherbondy | 222/569 |
| 2,873,886 | A | * | 2/1959 | Miskel et al. | 222/91 |
| 2,953,285 | A | * | 9/1960 | McKelvey | 222/567 |
| 2,981,449 | A | * | 4/1961 | Perkins | 222/541.2 |
| 3,016,173 | A | * | 1/1962 | Stull | 222/541.2 |
| 3,058,632 | A | * | 10/1962 | Stremmel | 222/567 |
| 3,087,654 | A | * | 4/1963 | Moore | 401/9 |
| 3,208,638 | A | * | 9/1965 | Frenzel et al. | 222/39 |
| RE26,180 | E | | 4/1967 | Frenzel et al. | |
| 3,353,721 | A | | 11/1967 | Love | |
| 3,523,630 | A | | 8/1970 | Catapano | |
| 3,841,537 | A | | 10/1974 | Marg et al. | |
| 4,258,884 | A | * | 3/1981 | Rogers | 239/390 |
| 4,284,213 | A | * | 8/1981 | Lee | 222/541.2 |
| 4,382,530 | A | * | 5/1983 | Calisto | 222/567 |
| 4,619,613 | A | * | 10/1986 | Dragan | 433/90 |
| 4,957,225 | A | * | 9/1990 | Childers | 222/568 |
| 5,020,702 | A | | 6/1991 | James | |
| 5,067,501 | A | | 11/1991 | Auger | |
| 5,104,013 | A | * | 4/1992 | Hawley | 222/566 |
| 5,154,327 | A | | 10/1992 | Long | |
| 5,248,071 | A | * | 9/1993 | Ray | 222/568 |
| 5,249,716 | A | * | 10/1993 | O'Sullivan | 222/568 |
| 5,301,835 | A | * | 4/1994 | Fulks et al. | 222/95 |
| 5,370,271 | A | * | 12/1994 | Segatz | 222/95 |
| 5,749,498 | A | * | 5/1998 | Lavoie et al. | 222/192 |
| 5,833,099 | A | * | 11/1998 | Boaz et al. | 222/568 |
| 5,882,133 | A | * | 3/1999 | Chao et al. | 401/266 |
| 6,016,937 | A | * | 1/2000 | Clay | 222/330 |
| 6,152,332 | A | | 11/2000 | Funk | |
| 6,357,450 | B1 | * | 3/2002 | Paice | 132/114 |
| 6,450,723 | B1 | * | 9/2002 | Lithgow | 401/266 |
| 6,464,112 | B2 | * | 10/2002 | Summons et al. | 222/327 |
| D468,601 | S | * | 1/2003 | Horst | D8/14.1 |
| D476,538 | S | * | 7/2003 | Dorff et al. | D8/14.1 |
| 6,981,611 | B2 | * | 1/2006 | Carruth et al. | 222/1 |
| 7,325,995 | B2 | * | 2/2008 | Keller | 401/266 |
| 7,387,222 | B2 | * | 6/2008 | Thompson et al. | 222/527 |
| 7,445,135 | B2 | * | 11/2008 | Miyata et al. | 222/326 |
| 7,478,736 | B2 | * | 1/2009 | Morgan | 222/107 |
| 7,631,790 | B2 | * | 12/2009 | Braams | 222/571 |
| 7,690,530 | B2 | * | 4/2010 | Schneider et al. | 222/63 |
| D660,106 | S | * | 5/2012 | Cross | D8/14.1 |
| 8,397,959 | B2 | * | 3/2013 | Helmenstein | 222/538 |
| 2003/0178446 | A1 | * | 9/2003 | Osgood | 222/327 |
| 2004/0211794 | A1 | * | 10/2004 | O'Jack | 222/568 |
| 2005/0006413 | A1 | * | 1/2005 | Miyata et al. | 222/327 |
| 2005/0029314 | A1 | * | 2/2005 | Williams et al. | 222/527 |
| 2005/0051571 | A1 | * | 3/2005 | Carruth et al. | 222/1 |
| 2005/0082317 | A1 | | 4/2005 | Coll | |
| 2005/0150912 | A1 | | 7/2005 | Casey et al. | |
| 2005/0230439 | A1 | * | 10/2005 | McKee | 222/568 |
| 2006/0016831 | A1 | * | 1/2006 | Murray | 222/153.13 |
| 2006/0049218 | A1 | * | 3/2006 | Chick | 222/566 |
| 2006/0118580 | A1 | * | 6/2006 | Spencer | 222/327 |
| 2007/0102484 | A1 | * | 5/2007 | Baldwin | 228/101 |
| 2007/0138216 | A1 | * | 6/2007 | DeLaossa | 222/567 |
| 2007/0235475 | A1 | * | 10/2007 | Schneider et al. | 222/325 |
| 2007/0290004 | A1 | * | 12/2007 | Lee et al. | 222/330 |
| 2009/0108033 | A1 | * | 4/2009 | Quinn et al. | 222/568 |
| 2009/0179045 | A1 | * | 7/2009 | Cadden | 222/94 |
| 2010/0237104 | A1 | * | 9/2010 | Schneider et al. | 222/330 |
| 2011/0062189 | A1 | * | 3/2011 | Kapec et al. | 222/326 |
| 2011/0248053 | A1 | * | 10/2011 | Ritter von Schwarzenfeld | 222/330 |

* cited by examiner

FIG.9
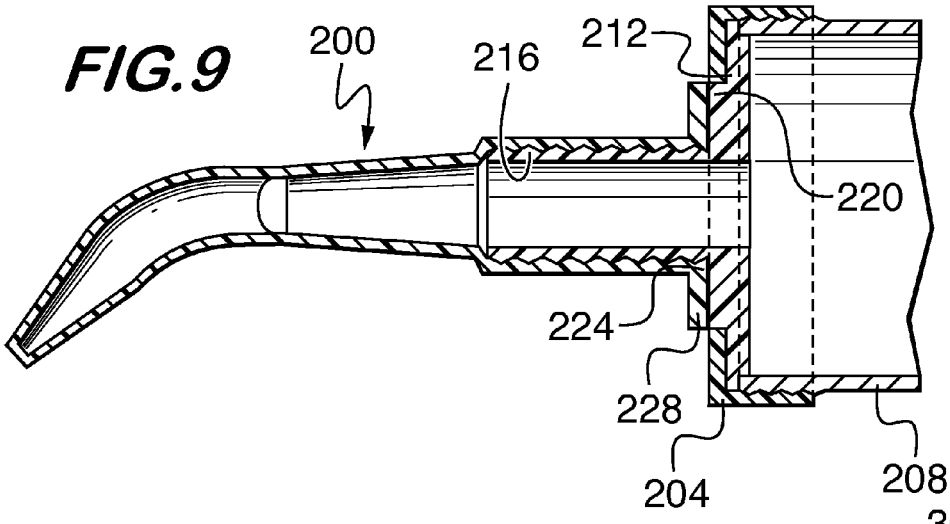
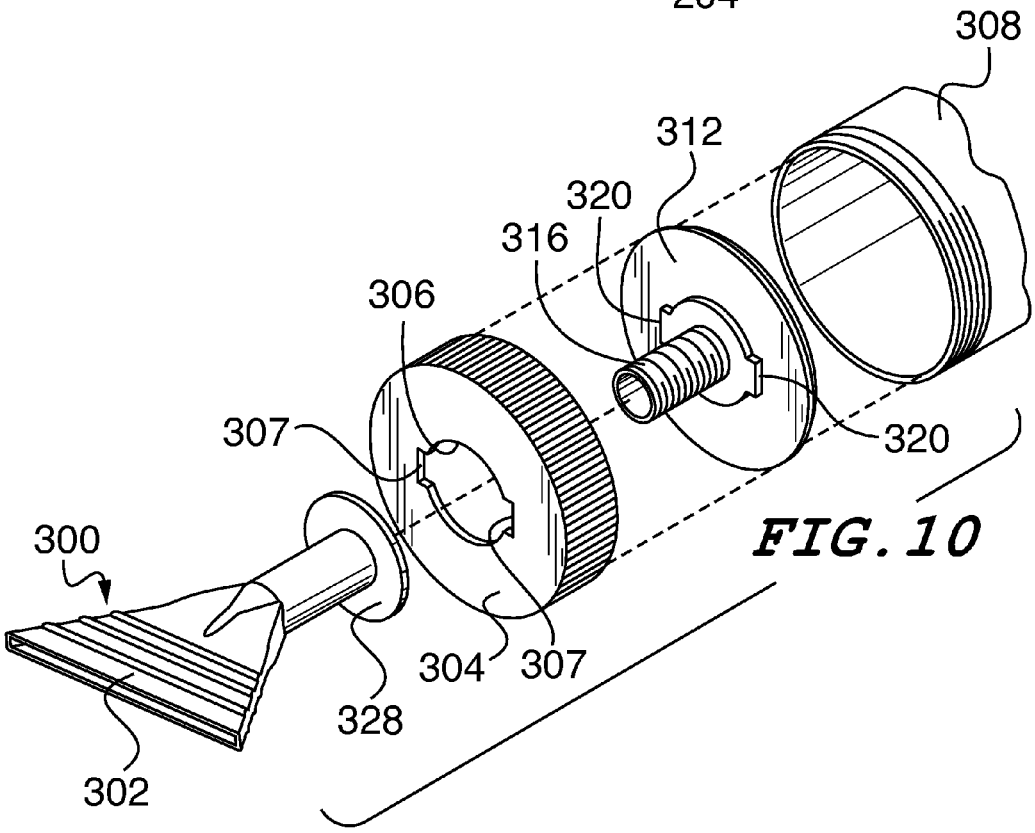
FIG.10

COVE BASE NOZZLE FOR DISPENSING APPLICATIONS

RELATED APPLICATIONS

This application is a continuation-in-part application that claims the benefit under 35 U.S.C. §120 of U.S. application Ser. No. 12/724,025 filed on Mar. 15, 2010, entitled COVE BASE NOZZLE FOR DISPENSING APPLICATIONS, which in turn claims the benefit under 35 U.S.C. §119(e) of Provisional U.S. Application Ser. No. 61/160,853, filed on Mar. 17, 2009, also entitled COVE BASE NOZZLE FOR DISPENSING APPLICATIONS, all of whose entire disclosures are incorporated by reference herein.

BACKGROUND OF THE INVENTION

This invention relates generally to nozzles for handheld dispensing tools, and more specifically to nozzle for dispensing tools employed to dispense viscous materials such as gluing and sealing materials and the like.

Dispensing devices for the application of various viscous material products such as construction adhesives, caulking materials, grease, automotive windshield sealant, dual component reactive resins, sealants, and the like, are well known throughout many industries. Such dispensing devices ideally allow the viscous material to be applied in an accurate, mess-free, and waste-free manner.

Dispensing devices are often in the form of a dispensing gun, or caulking gun. Dispensing devices generally include a squeezable handle and trigger assembly which is operative for advancing the pistons of the dispensers and for maintaining the pistons in advanced positions when the trigger portions of the dispenser devices are released. The viscous materials can be packaged in a variety of forms; some of the most common are cartridge form, collapsible form, and bulk form.

Cartridges are most often designed with a nozzle through which a viscous material composition can be extruded. These cartridges were adapted to be loaded into dispensing devices equipped with mechanisms to push the sealant composition out of the cartridge package. Cartridges, depending on the kind of storage required for the viscous material composition, are generally made from paper, foiled lined paper, plastic, and various kinds of molded and laminated constructions.

The cartridges are typically tubes having a sealed dispensing outlet, such as a conical tip, disposed on one end, with the other end being open for receiving a plunger mechanism or the like from the dispensing device. Just inside the cartridge's open end is a slidably-sealed, axially-movable piston, disc, or the like. For use, the cartridge is placed in a retaining/dispensing section of the dispensing device, and the plunger is brought into contact with the piston. When a user desires to dispense product, the cartridge's dispensing outlet is unsealed, typically by cutting, and the plunger is forced against the piston. This forces the piston axially down the tube and against the product, which in turn is dispensed through the dispensing outlet.

Collapsible tubes are also popular containers for viscous materials. Collapsible packaging has been known in the trade for many years, and offers the benefits of providing good shelf stability for the contained chemicals, low package cost, and minimal packaging waste. Collapsible packages are generally known in the art as a "sausage" or "chub." Collapsible packaging has a collapsible wall that is, typically, sealed at each end. While collapsible package can be used to contain non-reactive viscous material products, the collapsible package is typically moisture impervious, thus allowing the collapsible package to contain reactive viscous material products also (typically reactive viscous material products are ones that react when exposed to humidity in the air).

Bulk forms of the viscous material may be used with dispensing devices which have a dispensing chamber adapted to be filled directly with the bulk viscous material. All of these options (i.e., cartridge, bulk form, and collapsible form) can be employed in dual component dispensing devices as well as in single component dispensing devices. Moreover, the nozzles of the present invention can be employed with each of these options.

In many applications, multiple beads of adhesive are applied to the parts to be joined, where the surface area of the parts is large enough to require more than a single bead for adequate coverage and adhesion. A nozzle that emits multiple beads simultaneously increases application speed and provides a uniform separation distance between beads. Increased application speed ensures that, in the case of an adhesive, the amount of time that the adhesive is exposed to the air before the parts to be joined are affixed is reduced, thus improving adhesion and allowing for more uniform adhesion across large work areas. Nozzles with multiple dispensing outlets are known for this purpose. Not all applications, however, require as many beads of material as are available in presently available multi-tipped application nozzles, which typically have three or five outlets.

Therefore, there exists a need for a multi-tipped application nozzle for viscous materials wherein the user can select which tips are active and which do not eject material. Also, there exists a need for a multi-tipped application nozzle wherein the user can control the size of the nozzle opening to control the amount of the material to be dispensed. Also, there exists a need for an application nozzle which can be used in combination with a dispensing device regardless of the manner in which the viscous material is packaged, i.e., cartridge form, collapsible form, or bulk form. All references cited herein are incorporated by reference in their entireties.

BRIEF SUMMARY OF THE INVENTION

A nozzle is disclosed for dispensing viscous material comprising a plurality of dispensing tubes having dispensing tips and a single input cavity adapted to accept the viscous material. In an embodiment, at least one of the dispensing tips is manufactured closed and can be opened at the user's discretion.

In a further embodiment, the nozzle input cavity is adapted to accept a single nozzle from a material container, such as a cartridge. In a further embodiment, the nozzle includes a detachable locking plate enabling attachment of the nozzle to the front cap of a device for dispensing material in bulk form. In a further embodiment, the nozzle includes a detachable locking plate enabling attachment of the nozzle to the front cap of a device for dispensing material from a collapsible package, such as a sausage or chub.

In a further embodiment, the nozzle has a flange at the input tube end, and the flange holds the nozzle between a dispensing tool end-stop and a material container, such as the tip of a tube of adhesive or sealant. In an embodiment, the dispensing tubes are at an angle to the centerline of the material dispenser. In a further embodiment, the nozzle screws into a threaded socket on a dispensing tool by a thread on the outside of the input tube.

In a further embodiment, the nozzle has a flange at the input tube end, and the flange holds the nozzle between a dispensing tool end-stop and a material container, such as the tip of a tube of adhesive or sealant. In an embodiment, the dispensing tubes are at an angle to the centerline of the material dispenser. In a further embodiment, the nozzle screws into a threaded socket on a dispensing tool by a thread on the outside of the input tube.

BRIEF DESCRIPTION OF SEVERAL VIEWS OF THE DRAWINGS

The invention will be described in conjunction with the following drawings in which like reference numerals designate like elements and wherein:

FIG. 9 is a sectional view taken along line 9-9 of FIG. 8;

FIG. 10 is an exploded view of a third alternative embodiment of the nozzle of the present invention wherein the flange and mounting plate are incorporated with a nozzle of conventional design and shape, e.g., a ribbon nozzle head, to provide versatility to enable mounting of the nozzle to the dispensing end of a dispenser, regardless of the manner in which the viscous material is packaged, i.e., cartridge form, collapsible form, or bulk form; and, FIG. 11 is an enlarged view of the third alternative embodiment of FIG. 10 shown mounted to the dispensing end of a sausage type or bulk type dispensing device.

DETAILED DESCRIPTION OF THE INVENTION

Figure 1:
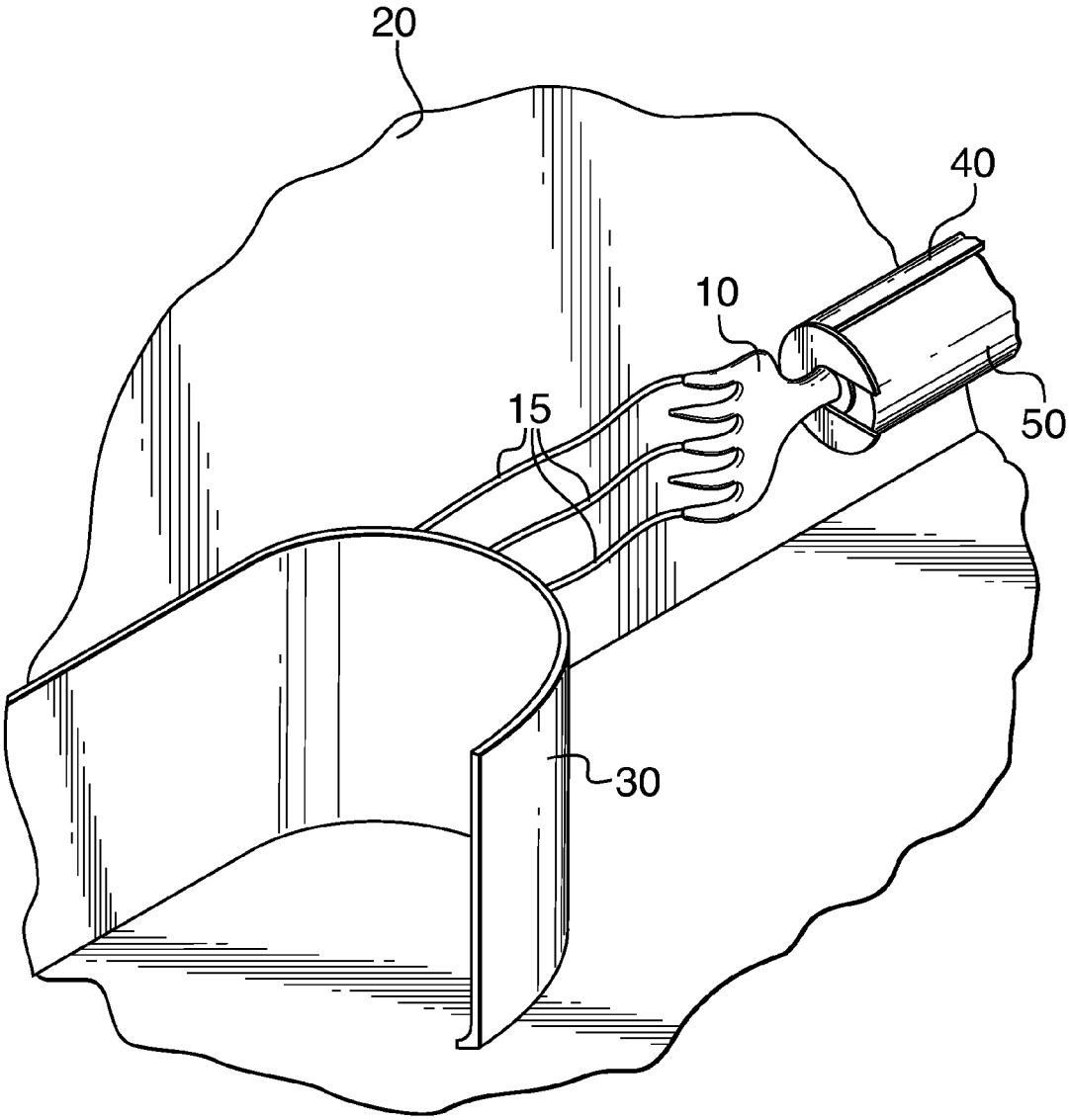
FIG. 1 is a drawing of an exemplary multi-tip nozzle of the present invention in use.

FIG. 1 shows an exemplary multi-tipped nozzle 10 applying three beads of material 15 to a surface 20 to which a flexible covering 30 is to be affixed. A typical use of the multi-tipped nozzle 10 is application of material 15, e.g., adhesive, for installing cove base molding 30. Referring now to FIGS. 1-4, the nozzle 10 is shown in use attached to a dispensing device, partially shown at 40. A hard cartridge, partially shown at 50, containing material 15 to be dispensed is shown housed within the dispensing device 40. The hard cartridge 50 that is used in conjunction with such dispensing devices 40 is of a standard size and configuration and comprises a front wall 31, a back wall (not shown), and tubular body portion containing material therein to be dispensed. A hard cup-shaped movable plunger (not shown) is located at the rearward end of the hard cartridge 50. The hard cartridge 50 includes its own dispensing nozzle 33 located at the forward end thereof. As best shown in FIG. 3, the dispensing nozzle 33 of the hard cartridge 50 extends through an opening located in an end plate 41 at the front end of the dispensing device 40 as it extends within the proximal base portion 8 of the nozzle 10. The moveable plunger provides means for the dispensing device 40 to apply dispensing pressure to the material within the cartridge 50. When the cartridge 50 is appropriately registered within the dispensing device 40, the moveable plunger is arranged to be moved in a forward ejecting direction towards the cartridge dispensing nozzle 33 to expel material from the cartridge 50.

While the invention has been described in detail and with reference to specific examples thereof, it will be apparent to one skilled in the art that various changes and modifications can be made therein without departing from the spirit and scope thereof.

As shown in FIG. 1, three of the five tips of the multi-tipped nozzle 10 are open and emitting material, and two of the tips remain closed.

Figure 2:
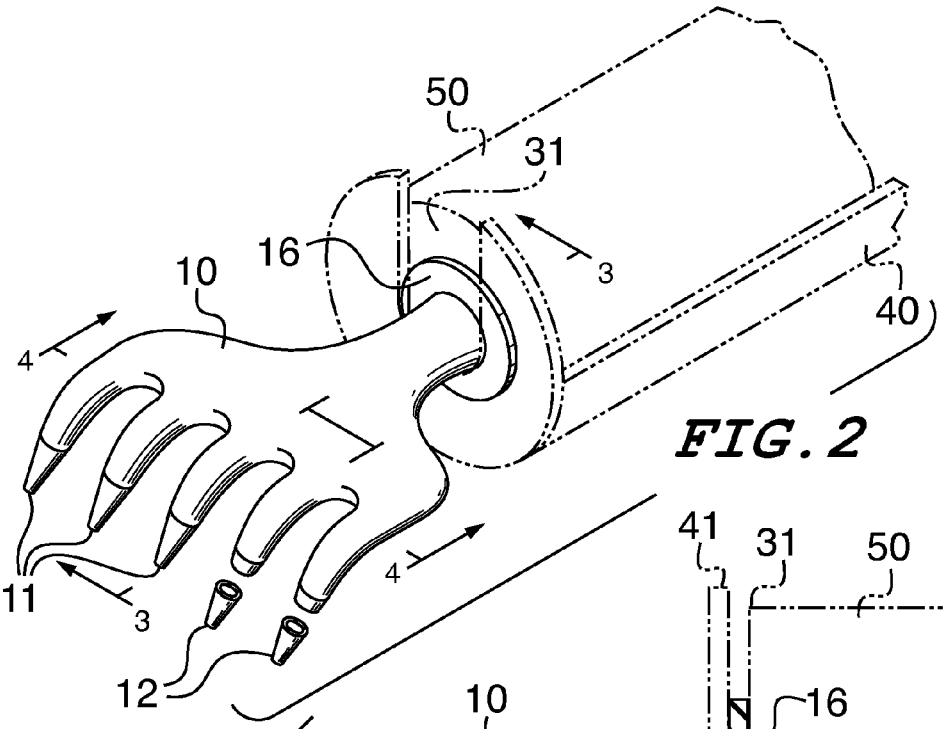
FIG. 2 is a drawing of an exemplary multi-tip nozzle of the present invention with two tips cut open for dispensing material.
Figure 3:
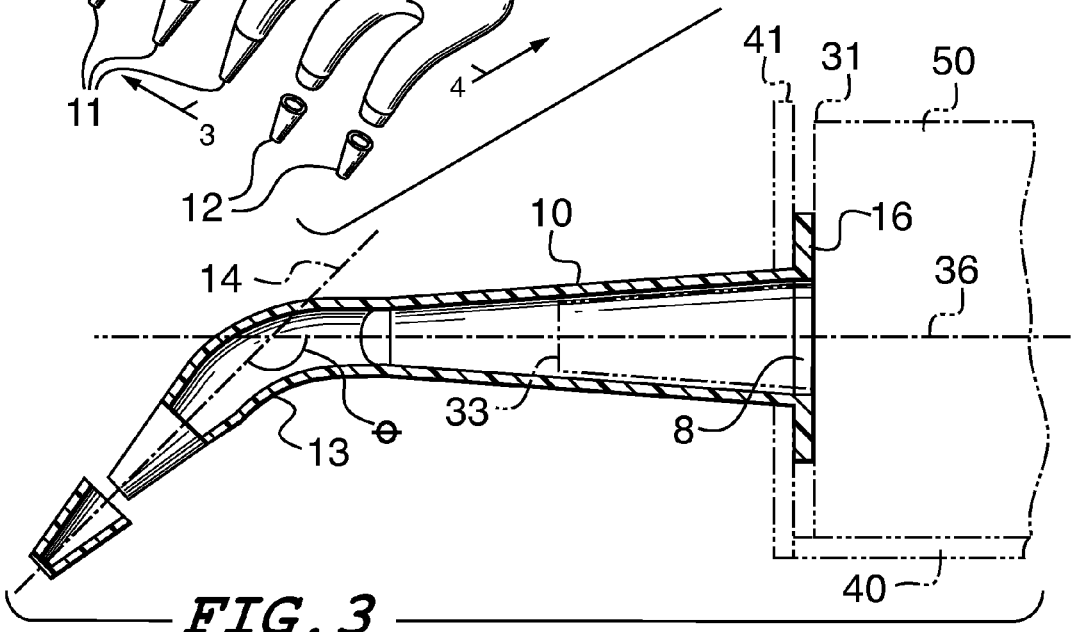
FIG. 3 is a sectional view taken along line 3-3 of FIG. 2.

FIG. 2 shows a multi-tipped nozzle 10 similar to the one shown FIG. 1. As shown in FIG. 2, three nozzle tips 11 remain in place over nozzle tubes 13 to prevent material 15 from being dispensed through those nozzle tubes, while two nozzle tips 12 have been cut to open those two nozzle tips 12 to allow material 15 to be dispensed therefrom. In an exemplary embodiment, the multi-tipped nozzle 10 is blow-molded high density polyethylene and the nozzle tips 12 are easily removed with a knife. In alternate embodiments (not shown), the nozzle tips are threaded and can be removed and replaced for applications where, for instance, the multi-tipped nozzle 10 will be used more than once.

Referring now to FIG. 3, each of the nozzle tubes 13 is bent, placing the centerline 14 of the tips 11 and 12 at an oblique angle θ to the centerline 36 of the hard cartridge 50. While the invention encompasses both straight nozzle tubes and bent tubes 13, the configuration shown in FIGS. 1-3 is especially useful in that it provides a more comfortable positioning of the dispensing device 40 relative to the surface 20 on which the material 15 is to be applied, e.g., a vertical wall surface. The bent tubes 13 also afford easier access to tight areas that might not be accessible with straight tubes.

Figure 4:
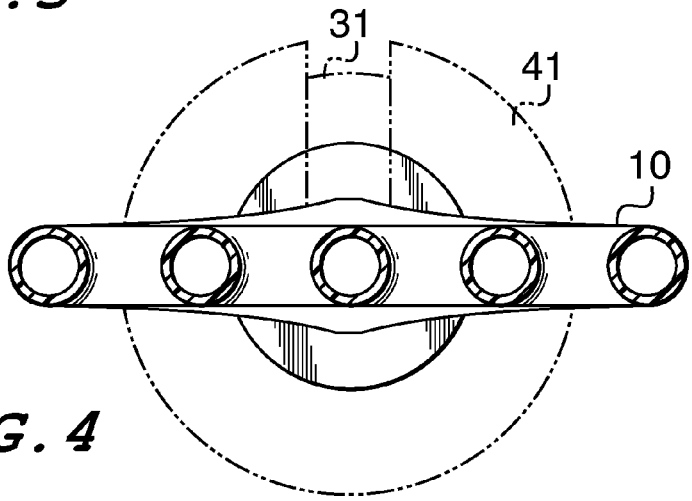
FIG. 4 is a sectional view taken along line 4-4 of FIG. 2.

FIG. 3 clearly shows how, in this exemplary embodiment, the multi-tipped nozzle 10 includes a flange 16 located at a proximal base portion 8 of the nozzle 10. The flange 16 is sandwiched between the end plate 41 of the dispensing device 40 and the front wall 31 of the hard cartridge 50. FIG. 3 also shows the nozzle 33 of the hard cartridge 50 extending through a front opening in the dispensing device 40 and into the proximal base portion 8 of the multi-tip nozzle 10. The force of the plunger (not shown) that forces material through the hard cartridge 50 forces the front wall 31 of the hard cartridge 50 against the nozzle flange 16, which is in turn forced against the end plate 41 of the dispensing device 40, thus holding the nozzle 10 firmly in place with respect to both the dispensing device 40 and the hard cartridge 50. FIG. 4 is a cross section view of the nozzle 10 taken at section lines labeled 4 in FIG. 2.

Figure 5:
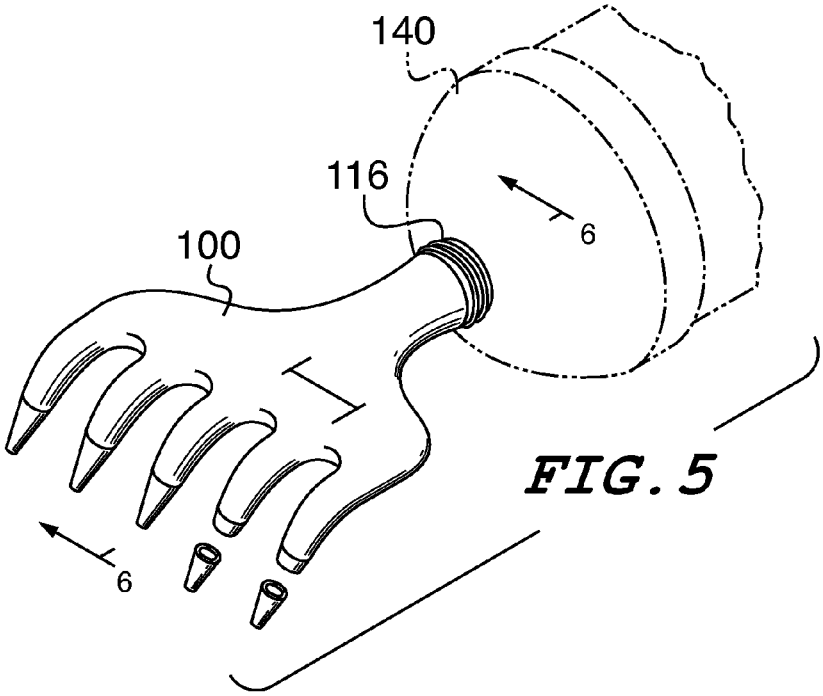
FIG. 5 is drawing of an alternate embodiment of a multi-tip nozzle.
Figure 6:
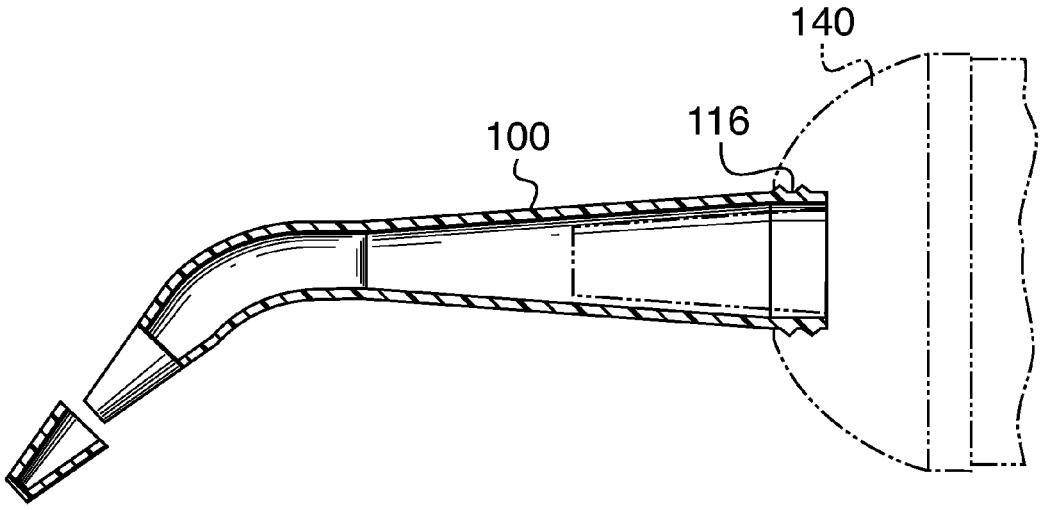
FIG. 6 is a sectional view taken along line 6-6 of FIG. 5.

In an alternate embodiment, shown in FIGS. 5 and 6, the nozzle 100 has external threads 116 at the inlet end that mate with internal threads (not shown) on the dispensing device 140. In this embodiment, the nozzle 100 is screwed into the end of the dispensing device 140. One application where this is practical is for dispensing devices adapted to accept bulk material not contained in a separate tube with a nozzle or for so-called "sausage" containers of material that do not have nozzles and which are simply opened at one end and the material forced out of the dispensing device, which comprises a complete cylinder with a plunger at one end and a threaded hole to accept the nozzle at the other end. Other types of nozzle-to-dispenser attachment means are also possible within the scope of the invention, including snap fit and twist and lock type fits.

Figure 7:
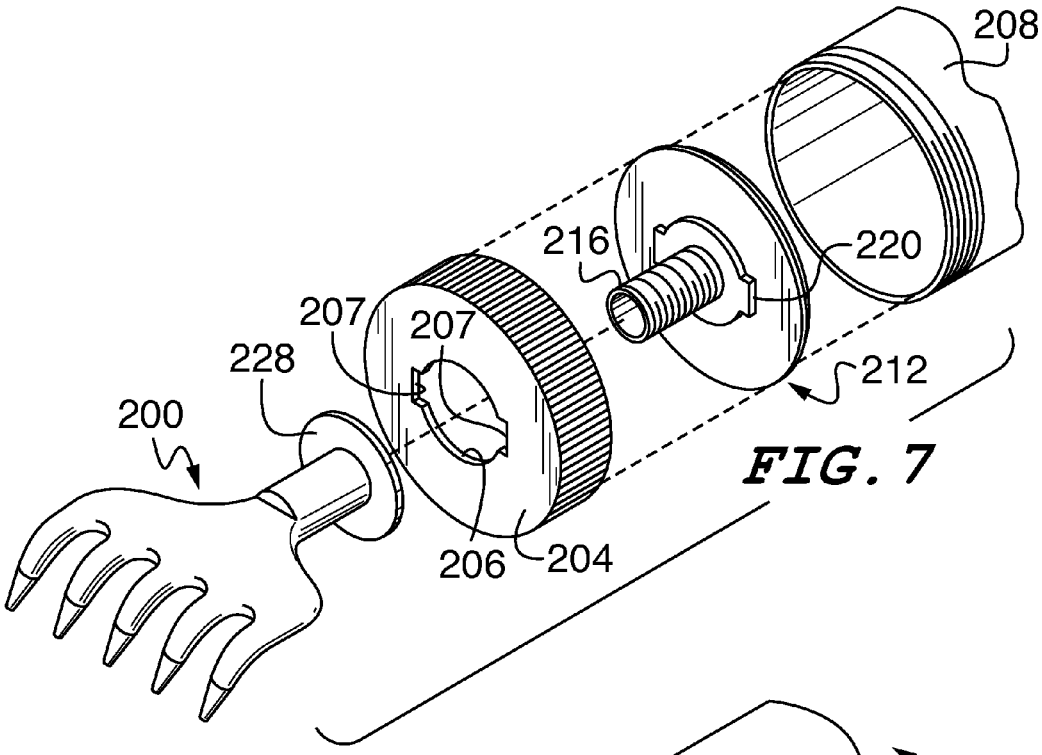
FIG. 7 is an exploded view of a second alternative embodiment of the multi-tip nozzle of the present invention having versatility to be mounted to the dispensing end of a dispenser, regardless of the manner in which the viscous material is packaged, i.e., cartridge form, collapsible form, or bulk form.
Figure 8:
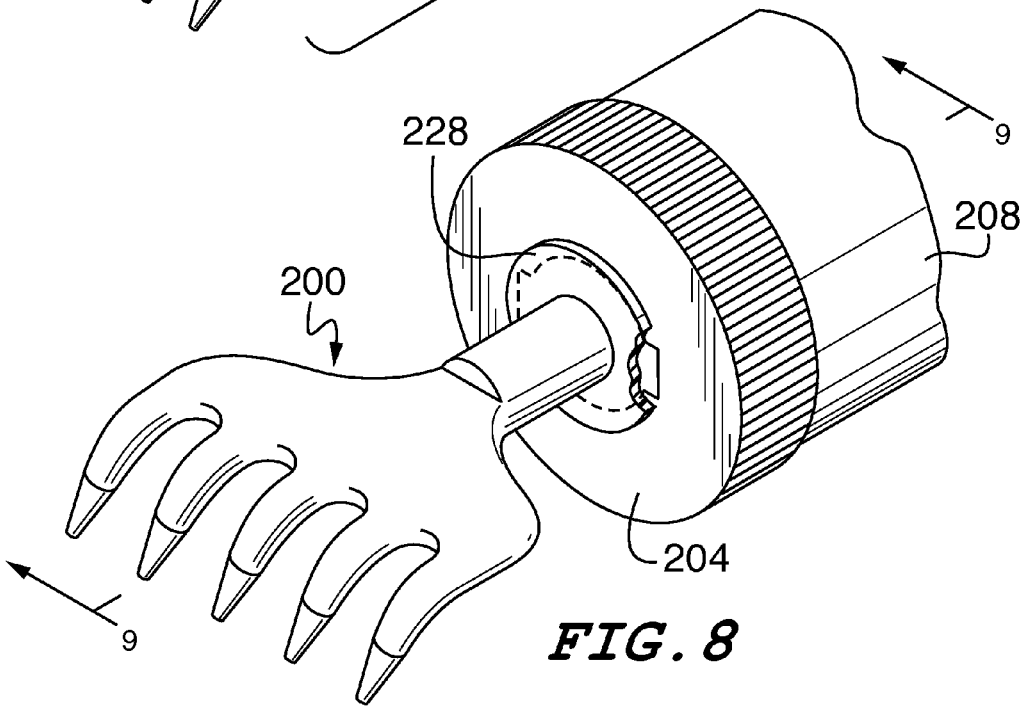
FIG. 8 is an enlarged view of the second alternative embodiment of FIG. 7 shown mounted to the dispensing end of a sausage type or bulk type dispensing device.

Referring now to FIGS. 7 through 9, there is shown therein a second alternative embodiment of the multi-tipped nozzle 200 of the present invention. As with the prior embodiments described herein, a typical use of the multi-tipped nozzle 200 is application of a viscous material, e.g., adhesive, for installing cove base molding. Industrial quality guns such as that shown in FIGS. 7-9 of the drawings are filled generally in two different manners. The first is by unscrewing a front cap 204 and engaging the front of the barrel 208 with a bulk container (not shown) of a viscous material, such as an adhesive whereupon the piston assembly is retracted rearwardly to draw in a charge of adhesive from the bulk container (not shown).

As shown in FIGS. 7 through 9, the front cap 204 includes an internal thread and is arranged for screwing onto the externally threaded dispensing end of the barrel 208. The front cap 204 includes a central opening 206 and a pair of opposed cutouts 207 extending radially from the central opening 206. Prior to replacing the front cap 204 onto the barrel 208 filled with bulk material, the nozzle 200 is secured to the front cap 204 using a locking plate 212. The locking plate 212 includes a centrally-located externally threaded shank 216 and opposed locking tabs 220 that extend radially from the threaded shank 216. The threaded shank 216 is arranged to extend through the central opening 206 of the front cap 204 and into the proximal base portion 224 of the nozzle 200 (FIG. 9). As best shown in FIG. 9, the proximal base portion 224 of the nozzle 200 is internally threaded and arranged to threadably receive the externally threaded shank 216. As the threaded shank 216 of the locking plate 212 is placed through the central opening 206 of the front cap 204, and screwed into the nozzle 200, the opposed locking tabs 220 of the locking plate 212 seat into the opposed cutouts 207 of the front cap 204 to lock the nozzle 200 to the front cap 204. Thereafter, the front cap 204, with the nozzle 200 locked thereon, may be replaced onto the barrel 208 and the dispenser is ready for use. As best shown in FIGS. 7 and 9, the threaded shank 216 is hollow along its length to enable the passage of bulk material from the barrel 208, through the threaded shank 216 and into the nozzle 200 during dispensing.

A second and more recently available method of filling the barrel with adhesive is by the use of what are known as "sausage" packages (not shown). These "sausage" packages are tube-like members formed generally of a thin plastic material such as mylar which is generally in the range of 2 mils thickness. Such packages are filled and are approximately the length of the barrel 208 and are clamped on or tied off at their ends by an appropriate clamp or tie. In use, the front cap 204 is unscrewed and the "sausage" package is inserted into the barrel 208 after the piston (not shown) is retracted. Thereafter, the end of the package closest the front cap 204 is cut open. The nozzle 200 is attached to the front cap 204 using the locking plate 212 in the manner described above and the front cap 200 is threaded back onto the barrel 208. The operation of the gun is as in the conventional manner in that the hand actuator (not shown) drives the piston rod and piston assembly forward compressing and extruding the compound within the package through the nozzle 200 of the gun.

The multi-tipped nozzle 200 also includes a flange 228 arranged for being sandwiched between the end plate of a dispensing device and the front wall of a hard cartridge as described in connection with the first embodiment above. In this manner, the multi-tipped nozzle 200 in combination with the locking plate 212 of this embodiment provides versatility. That is, when it is desired to use the multi-tipped nozzle 200 for dispensing material in bulk form or from a collapsible package or sausage, the locking plate 212 may be utilized for fastening the nozzle 200 to the barrel front cap 204 prior to screwing the front cap 204 to the dispensing end of the barrel 208. Alternatively, when it is desired to use the multi-tipped nozzle 200 for dispensing material from a cartridge, utilizing the flange 228, the nozzle 200 may be sandwiched between the dispensing device end plate and the hard cartridge front wall. In this manner, the locking plate 212 is not utilized.

While the invention has been described in detail and with reference to specific examples thereof, it will be apparent to one skilled in the art that various changes and modifications can be made therein without departing from the spirit and scope thereof. For example, FIGS. 7-9 illustrate the flange 228 and locking plate 212 features being utilized in combination with a multi-tipped nozzle 200. However, it should be understood that these features, i.e., the flange and locking plate, can also be incorporated into any nozzle of conventional or standard design. For example, referring now to FIGS. 10 and 11, there is shown therein a third alternative embodiment of the 300 of the present invention, wherein the flange and locking plate features have been incorporated into a conventional ribbon bead nozzle for providing ribbon or flat beads of adhesive or caulking material.

Figure 11:
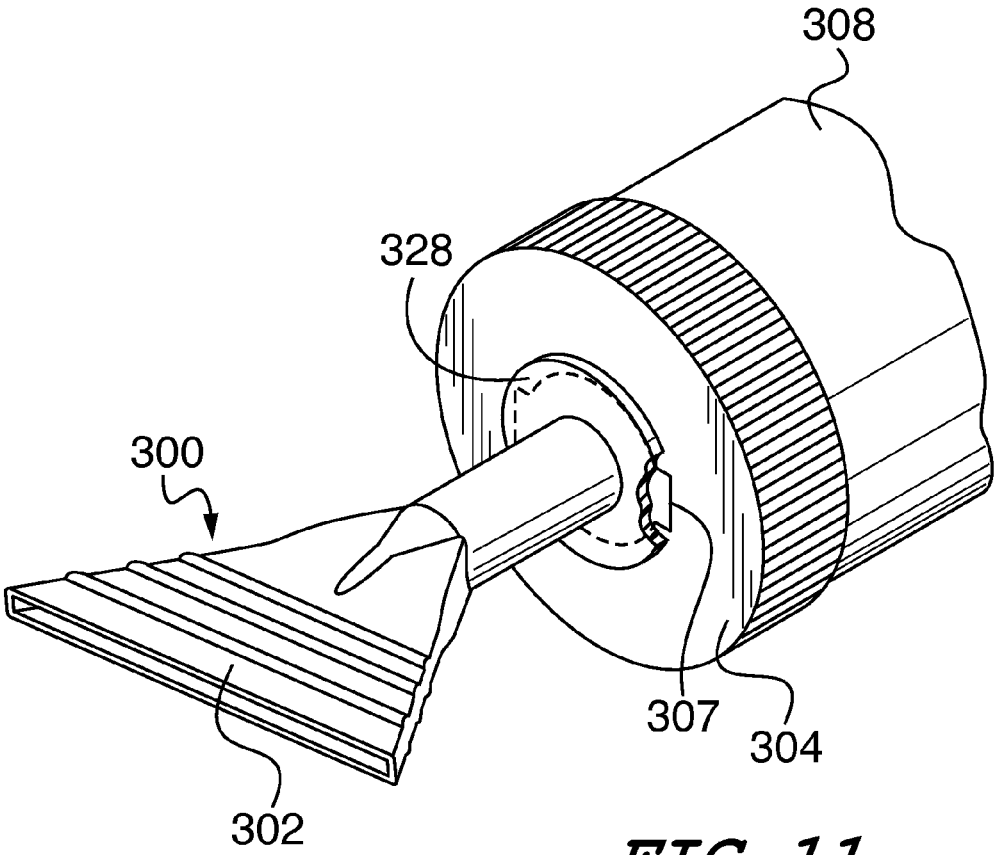

Referring now to FIGS. 10 and 11, the third alternative embodiment 300 includes a ribbon nozzle head 302 of conventional design and shape. The nozzle head 302 is arranged for dispensing a ribbon or flat bead of adhesive or caulking material having predetermined dimensions, e.g., a ⅛"×4" ribbon bead. The embodiment 300 includes a front cap 304 including an internal thread (not shown). The front cap 304 is arranged for screwing onto the externally threaded dispensing end of the barrel 308. The front cap 304 includes a central opening 306 and a pair of opposed cutouts 307 extending radially from the central opening 306. Prior to replacing the front cap 304 onto the barrel 308 filled with caulking material or adhesive, the nozzle 300 is secured to the front cap 304 using a locking plate 312. The locking plate 312 includes a centrally-located externally threaded shank 316 and opposed locking tabs 320 that extend radially from the threaded shank 316. The threaded shank 316 is arranged to extend through the central opening 306 of the front cap 304 and into the proximal base portion of the nozzle 300.

The ribbon nozzle 300 is internally threaded and arranged to threadably receive the externally threaded shank 316. As the threaded shank 316 of the locking plate 312 is placed through the central opening 306 of the front cap 304, and screwed into the nozzle 300, the opposed locking tabs 320 of the locking plate 312 seat into the opposed cutouts 307 of the front cap 304 to lock the nozzle 300 to the front cap 304. Thereafter, the front cap 304, with the nozzle 300 locked thereon, may be replaced onto the barrel 308 and the dispenser is ready for use. As best shown in FIG. 10, the threaded shank 316 is hollow along its length to enable the passage of bulk material from the barrel 308, through the threaded shank 316 and into the nozzle 300 during dispensing. The ribbon nozzle 300 also includes a flange 328 arranged for being sandwiched between the end plate of a dispensing device and the front wall of a hard cartridge as described in connection with the first embodiment above. In this manner, the ribbon nozzle 300 including the locking plate 312 and flange 328 of this embodiment provides versatility. That is, when it is desired to use the ribbon nozzle 300 for dispensing material in bulk form or from a collapsible package or sausage, the locking plate 312 may be utilized for fastening the nozzle 300 to the barrel front cap 304 prior to screwing the front cap 304 to the dispensing end of the barrel 308. Alternatively, when it is desired to use the ribbon nozzle 300 for dispensing material from a cartridge, utilizing the flange 328, the nozzle 300 may be sandwiched between the dispensing device end plate and the hard cartridge front wall. In this manner, the locking plate 312 is not utilized.

What is claimed is:

1. A nozzle assembly for dispensing viscous material, said nozzle assembly being convertible from use in combination with a device for dispensing viscous material packaged in a cartridge wherein when the cartridge is housed within such a dispensing device, a conical tip of the cartridge extends through an opening located in an end plate located at the front end of the dispensing device to use in combination with a device for dispensing viscous material provided in unpackaged bulk form, wherein said device for dispensing said viscous material provided in unpackaged bulk form includes a barrel having an elongate chamber for housing said viscous material in unpackaged bulk form, wherein said viscous material in unpackaged bulk form is drawn directly into said barrel by rearward retraction of a piston assembly also located within said barrel, said chamber including an opening at a distal dispensing end thereof, and an end cap being removably retained on said chamber distal end, said nozzle assembly comprising:

a. a nozzle comprising a proximal base portion, a distal tip portion, a hollow passageway extending between said proximal base portion and said distal tip portion, and an annular flange in proximity to said proximal base portion, wherein when dispensing viscous material from a cartridge, said base portion is arranged for receiving said cartridge conical tip therein and said flange is arranged for placement between said end plate of said dispensing device and said cartridge to retain said nozzle within said dispensing device for dispensing viscous material packaged within said cartridge;

b. a locking plate provided for utilization when said nozzle assembly is used in combination with a device for dispensing viscous material in said unpackaged bulk form, said locking plate including a shank arranged to extend through a central opening of said end cap and to engage with said proximal base portion of said nozzle assembly provided to tightly retain said nozzle to said end cap, said locking plate being disengagable from said nozzle assembly and removable therefrom when said nozzle assembly is used in combination with a device for dispensing viscous material packaged in a cartridge and;

c. said end cap additionally comprising cutouts extending radially from said central opening, said locking plate including radially extending locking tabs arranged to seat within said cutouts of said central opening of said end cap.

2. The nozzle assembly of claim 1, wherein said proximal base portion of said nozzle is internally threaded, and wherein said shank of said locking plate is externally threaded and arranged to screw into said proximal base portion for dispensing viscous material in bulk form.

3. The nozzle assembly of claim 2, wherein said externally threaded shank is hollow along its length.

4. The nozzle assembly of claim 1, wherein said nozzle tip portion comprises a plurality of nozzle dispensing tubes.

5. The nozzle assembly of claim 4, wherein each said nozzle dispensing tube is opened by removing a replaceable nozzle dispensing tip.

6. The nozzle assembly of claim 5, wherein each said nozzle dispensing tip is adapted to be opened at user-selectable opening sizes.

7. The nozzle assembly of claim 4, wherein each said nozzle dispensing tube includes a circular cross-section.

8. The nozzle assembly of claim 4, wherein said plurality of nozzle dispensing tubes comprises at least three nozzle dispensing tubes and corresponding nozzle dispensing tips, and wherein said nozzle dispensing tips are equally spaced from each other.

9. The nozzle assembly of claim 4, wherein said nozzle dispensing tubes comprise five nozzle dispensing tubes and five corresponding nozzle tips.

10. The nozzle assembly of claim 1, wherein said nozzle tip portion comprises a ribbon nozzle.

11. A nozzle assembly for dispensing viscous material, said nozzle assembly being convertible from use in combination with a device for dispensing viscous material packaged in a cartridge wherein when the cartridge is housed within such a dispensing device, a conical tip of the cartridge extends through an opening located in an end plate located at the front end of the dispensing device to use in combination with a device for dispensing viscous material contained in a sausage package, said sausage package dispensing device including a barrel having an elongate chamber for housing therein a sausage package containing viscous material, said chamber including an opening at a distal dispensing end thereof, and an end cap being removably retained on said chamber distal end, said nozzle assembly comprising:

a. a nozzle comprising a proximal base portion, a distal tip portion, a hollow passageway extending between said proximal base portion and said distal tip portion, and an annular flange in proximity to said proximal base portion, wherein when dispensing viscous material from a cartridge, said base portion is arranged for receiving said cartridge conical tip therein and said flange is arranged for placement between an end plate of said dispensing device and said cartridge to retain said nozzle within said dispensing device for dispensing viscous material packaged within said cartridge;

b. a locking plate provided for utilization when said nozzle assembly is used in combination with a device for dispensing viscous material contained in a sausage package, said locking plate including a shank arranged to extend through a central opening of said end cap and to engage with said proximal base portion of said nozzle assembly to tightly retain said nozzle assembly to said end cap, said locking plate being disengageable from said nozzle assembly and removeable therefrom when said nozzle assembly is used in combination with a device for dispensing viscous material packaged in a cartridge; and, c. said end cap additionally comprising cutouts extending radially from said central ppening, said locking plate including radially extending locking tabs arranged to seat within said cutouts of said end cap central opening.

* * * * *